US009660358B2

(12) United States Patent
Ramm et al.

(10) Patent No.: US 9,660,358 B2
(45) **Date of Patent: *May 23, 2017**

(54) CONTACT ELEMENT FOR AN ELECTRICAL PLUG CONNECTOR DEVICE

(71) Applicant: Bals Elektrotechnik GmbH & Co. KG, Kirchhundem-Albaum (DE)

(72) Inventors: Andreas Ramm, Kirchhundem (DE); Mareike Bankstahl, Kirchhundem (DE)

(73) Assignee: Bals Elektrotechnik GmbH & Co. KG, Kirchhundem-Albaum (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/187,481

(22) Filed: Jun. 20, 2016

(65) Prior Publication Data

US 2016/0315400 A1 Oct. 27, 2016

Related U.S. Application Data

(63) Continuation of application No. 14/125,815, filed as application No. PCT/EP2012/002757 on Jun. 29, 2012, now Pat. No. 9,407,018.

(30) Foreign Application Priority Data

| | | |
|---|---|---|
| Jul. 20, 2011 | (DE) | 20 2011 103 484 |
| Nov. 9, 2011 | (DE) | 20 2011 107 633 |
| Feb. 8, 2012 | (DE) | 10 2012 002 350 |

(51) Int. Cl.
*H01R 9/24* (2006.01)
*H01R 4/48* (2006.01)
(Continued)

(52) U.S. Cl.
CPC ..... *H01R 4/4818* (2013.01); *H01R 4/023* (2013.01); *H01R 4/48* (2013.01); *H01R 43/02* (2013.01); *H01R 43/16* (2013.01)

(58) Field of Classification Search
CPC ..... H01R 4/185; H01R 8/183; H01R 13/04
(Continued)

(56) References Cited

U.S. PATENT DOCUMENTS

| | | | |
|---|---|---|---|
| 3,634,817 | A | 1/1972 | Wise |
| 3,803,537 | A | 4/1974 | Cobaugh et al. |

(Continued)

FOREIGN PATENT DOCUMENTS

| | | | |
|---|---|---|---|
| CN | 1297596 | A | 5/2001 |
| CN | 1423849 | A | 6/2003 |

(Continued)

OTHER PUBLICATIONS

"Chinese Office Action", issued in related Chinese Patent Application No. 2015080600939660 on Aug. 11, 2015.

(Continued)

*Primary Examiner* — Thanh Tam Le
(74) *Attorney, Agent, or Firm* — Kaplan Breyer Schwarz & Ottesen, LLP

(57) ABSTRACT

A contact element for an electrical plug connecting device, having a molded first end section and a molded elongated receiving section which defines a longitudinal axis for mechanical and electrical coupling and/or receiving a mating contact element designed to be complementary to the contact element of a plug connecting device to be paired with the electrical plug connecting device, both of which are manufactured of an electrically conductive material. The elongated receiving section extends essentially cylindrically from the first end section. This end section as well as the elongated cylindrical receiving section are molded to be free (Continued)

of seams and butt joints by shaping the electrically conducting material by means of a force acting at least predominantly parallel to the longitudinal axis, and at least the receiving section molded by shaping the electrically conducting material forms a cylindrical interior sheathed by the molded electrically conducting material along the longitudinal axis.

8 Claims, 13 Drawing Sheets

(51) Int. Cl.
*H01R 43/16* (2006.01)
*H01R 4/02* (2006.01)
*H01R 43/02* (2006.01)

(58) Field of Classification Search
USPC ..... 439/877, 878, 884, 891
See application file for complete search history.

(56) References Cited

U.S. PATENT DOCUMENTS 3,922,057 A 11/1975 Lemke et al.
4,053,199 A * 10/1977 Hollyday ..... H01R 13/7197 439/55
4,114,262 A 9/1978 Franck
4,434,552 A 3/1984 Brush, Sr. et al.
4,652,842 A 3/1987 Kling et al.
4,904,539 A * 2/1990 Kling ..... H01R 13/7197 29/464
5,340,337 A 8/1994 Pentz
5,397,254 A 3/1995 Powell
5,399,110 A 3/1995 Morello et al.
5,791,919 A 8/1998 Brisson et al.
6,004,172 A 12/1999 Kerek
7,611,392 B2 11/2009 Osborn, Jr. et al.
8,864,536 B2 10/2014 Hoffmeyer
9,407,018 B2 * 8/2016 Ramm ..... H01R 4/4818

FOREIGN PATENT DOCUMENTS

DE 202007017752 U1 2/2009
DE 202008014774 U1 3/2009
DE 102008006228 A1 8/2009
DE 202009005809 U1 10/2010
EP 0128990 A1 12/1984
EP 1783868 A1 5/2007
EP 1860734 A1 11/2007
EP 2028725 A1 2/2009
EP 2037547 A1 3/2009
WO 9953572 A1 10/1999
WO 2001080372 A1 10/2001

OTHER PUBLICATIONS

Related German Application No. DE 10 2012 002 350.2, "German Office Action", dated Nov. 24, 2014, Published in: DE.
Related International Patent Application No. PCT/EP2012/002757, "Translated International Preliminary Report on Patentability", dated Jan. 23, 2014, Publisher: PCT, Published in: EP.
Related International Patent Application No. PCT/EP2012/002757, "International Preliminary Report on Patentability & Response to IPRP", dated May 23, 2012, Publisher: PCT, Published in: EP.
Related International Patent Application No. PCT/EP2012/002757, "International Search Report", dated Oct. 4, 2012, Publisher: PCT, Published in: EP.
"Notice of Allowance" issued in U.S. Appl. No. 14/125,815, dated May 6, 2016, Publisher: USPTO, Published in: US.
"Office Action" issued in U.S. Appl. No. 14/142,815, dated Aug. 10, 2015, Publisher: USPTO, Published in: US.
"Office Action" issued in U.S. Appl. No. 14/125,815, dated Dec. 31, 2015, Publisher: USPTO, Published in: US.

* cited by examiner

142

145
150
141

103
101
102
129
118
117
119

190
120'
102

194
192
102

191
120'

193
120"

115

115

115

191‘‘‘
120‘‘‘

190‘‘‘
191‘‘‘
120‘‘‘
102
7‘‘‘
8‘‘‘

129‘‘‘

116‘‘

140‘‘

102
101

140‘‘

116
144

140‘‘‘
143

100

102‘
105
101
103

X

140‘‘‘
105
102‘
141

140''

120'
102
101
103

140'

150
102
101
103

130

125
123
120
102
101
103

CONTACT ELEMENT FOR AN ELECTRICAL PLUG CONNECTOR DEVICE

CROSS-REFERENCE TO RELATED APPLICATIONS

U.S. patent Ser. No. 14/125815, filed on Dec. 12, 2013, German Application No. 202011103484.8, filed on Jul. 20, 2011, German Application No. 202011107633.8, filed on Nov. 9, 2011, and German Application No. 102012002350.2, filed on Feb. 8, 2012, are all incorporated herein by reference in their entirety.

FIELD OF THE INVENTION

The invention relates to an elongated contact element for an electrical plug connector device.

BACKGROUND OF THE INVENTION

In the prior art, electrical plug connector devices may fundamentally be designed as a socket or as a plug and they usually have a contact insert block, in which the generic elongated contact elements that are inserted are designed as elongated contact pins in the case of a plug as an electrical plug connector device and are designed as a socket in the case of an electrical plug connector device, the generic contact elements are embodied as elongated contact sockets. Such electrical plug connector devices are described in the standards DIN VDE 0623, IEC 60309-1, -2 and EN 60309-1, -2 in particular.

The contact elements that are used serve accordingly for the corresponding mechanical and electrical coupling to a mating contact element of a complementary design. An elongated contact pin is thus mechanically and electrically coupled to an elongated contact socket, i.e., the contact socket receives the contact pin in its interior and/or the contact pin receives the contact socket over its entire external extent. The sections of a contact element that serve the purpose of coupling and/or receiving a mating contact element are also referred to below and in the claims as the receiving section.

Furthermore, such a contact element will usually have a section adjacent to the receiving section or at a distance therefrom, to serve the purpose of mechanical and electrical coupling and/or to receive an electrical connecting conductor.

The generic elongated contact elements thus consist essentially of electrically conductive material, traditionally a metal.

EP 1 783 868 relates to one such contact element, designed as an elongated contact pin, which is molded from a flat solid material by blanking and bending and has an essentially hollow cylindrical cross section along its receiving section. The contact pin described there conforms to the description in the specifications DIN VDE 0623, EN 60309-2, and it saves on material in comparison with hollow cylindrical contact pins manufactured from solid material by cutting or abrasive removal of material and in comparison with contact pins of solid material, i.e., without a hollow cylindrical cross section. However, according to EP 1 783 868, edges that must be joined by intermeshing teeth abut against one another because of the contact pin being bent from blanked flat material with mushroom-molded extensions formed on one edge to engage with complementary recesses in the other abutting edge, so unwanted contaminants and/or moisture can penetrate into the edge interspaces.

It has been found in particular that contaminants and/or moisture penetrating into such edge interspaces and possibly remaining there can lead to unwanted oxidation and/or corrosion, which may in turn result in increased transfer resistances in power transmission.

SUMMARY OF THE INVENTION

An object of the present invention is to effectively counteract the disadvantages mentioned above.

Consequently, the present invention proposes to solve this problem with a contact element for an electrical plug connector device, which is made of an electrically conductive material and has a molded first end section and an elongated, molded receiving section, which defines the longitudinal axis and is used for mechanical and electrical coupling and/or receiving of a mating contact element, which has a complementary design to the contact element of a plug connector device that is to be paired with the electrical plug connector device, wherein the elongated receiving section extends from the first end section essentially in a cylindrical shape, and both the first end section and the elongated cylindrical receiving section are free of seams and butt joints due to shaping of the material of the electrically conductive material by means of a force acting at least predominantly parallel to the longitudinal axis, and at least the receiving section, which is molded by shaping the material of the electrically conductive material along the longitudinal side, forms a cylindrical interior, which is sheathed by the molded electrically conductive material.

According to the invention, it is thus possible now for the first time to produce a cylindrical receiving section having a cylindrical interior, which is completely closed on the circumference, i.e., on the cylindrical surface, and is free of seams and free of material transitions, and to do so without manufacturing it by using cutting or abrasive removal of a solid material.

In a first embodiment of the invention, there is no separate filling of the cylindrical interior, and consequently the receiving section forms a hollow cylindrical receiving section. In an alternative embodiment, the cylindrical interior may be filled at least partially by another filling material to be added subsequently and/or for the interior to receive one or more additional components, in particular depending on the field of application and/or use.

Based on the freedom from material transitions including seams and butt joints along the receiving section, the unwanted penetration of contaminants and/or moisture is significantly reduced and can even be prevented entirely, depending on the further embodiment of the contact element.

Consequently, because of the hollow cylindrical design according to the first embodiment of the contact element, weight is saved in any case in comparison with solid material contact elements and hollow cylindrical contact pins manufactured from solid material by cutting or abrasive removal of material.

However, even in the alternative embodiment in which the cylindrical interior is filled at least partially by another filling material introduced subsequently and/or receives one or more additional components, the weight and/or the cost of materials can be reduced in comparison with solid material contact elements and the cost of materials can be reduced in comparison with hollow cylindrical contact pins manufactured first from solid material by cutting or abrasive removal of material. In other words, if an at least partially filled interior is desired or stipulated, depending on the field of application and/or use, then the at least partial filling can be accomplished by using a less expensive material in comparison with the material used to shape the receiving section and/or by using a material with a lower density so it is lighter. In addition, materials with certain characteristics, in particular with certain physical, chemical and/or electrical characteristics, may provide such a filling material in a targeted manner.

Components for identification, labeling and/or localization have proven to be suitable in particular for receiving components in the interior. Such components may be in particular a passive type, i.e., those that are merely read out, in particular those that can be read out wirelessly, or they may be of an active type, i.e., those that can wirelessly transmit information to an external information processing unit either on their own or in response to an inquiry signal. In particular an RFID (radio frequency identification) chip has proven expedient as a component to be received. Furthermore, components to be received in the interior may be embedded within a filling material that fills the interior at least partially.

In the preferred embodiments, it is provided that at least the elongated cylindrical receiving section having a cylindrical interior is molded by using a deep-drawing method or an impact extrusion method, in particular from a flat material or is molded by using a die-casting method. Due to the use of such a use-optimized manufacturing process, the receiving section is completely closed on the circumference along its longitudinal extent and this also leads to savings of material in addition to weight savings in contrast with solid material contact elements and it leads to contact elements formed by methods involving the removal of material. The impact extrusion methods that have proven especially suitable include hollow reverse impact extrusion methods and hollow forward impact extrusion methods in particular.

Furthermore, a connecting device is expediently also formed on the first end section for mechanical and electrical coupling and/or to receive an electrical connecting conductor. The end of the elongated cylindrical receiving section opposite the first end section may be either open or closed. When using the preferred embodiments mentioned above, it has proven suitable to use a die-casting, deep-drawing or impact extrusion method, such that this end is closed first and then is optionally open subsequently. A completely closed contact pin can easily be manufactured in this case with the design of a connecting device on the first end section, while secondly a less complex die-casting, deep-drawing or impact extrusion mold can be designed for supplying a first end section on which a connecting device can be formed with little effort.

In an expedient embodiment, it has been proposed to this end that the connecting device designed on the first end section be molded by using a material-removing method and/or by using a blanking-bending method.

In a preferred embodiment, it is also provided that a connecting device designed on the first end section is mounted on this end section, in particular by screwing, riveting or joining, in particular by welding, soldering or otherwise joining.

In an alternative refinement, it is also proposed that the connecting device designed on the first end section along with the first end section and the receiving section are all molded in one piece.

BRIEF DESCRIPTION OF THE DRAWINGS

The invention is described in greater detail below on the basis of preferred embodiments with reference to the accompanying drawings, so that additional advantages and features of the invention will be obvious to those skilled in the art. The drawings show.

DETAILED DESCRIPTION

Figure 1B:
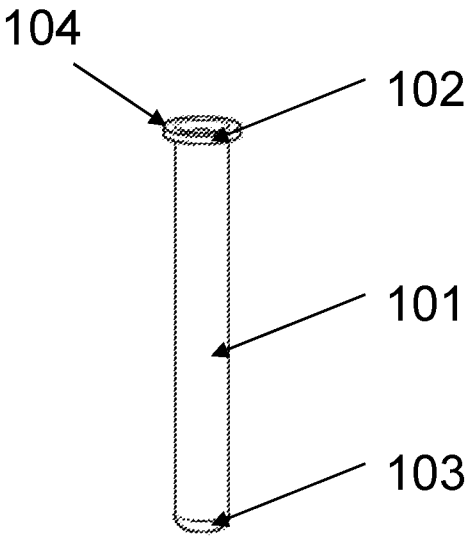
FIGS. 1*a* to 1*b* a first embodiment of a contact element according to the invention, FIGS. 2*a* to 2*d* a second embodiment according to the invention, based on the first embodiment, FIGS. 3*a* to 3*c* a third embodiment according to the invention, based on the first embodiment, FIGS. 4*a* to 4*d* a fourth embodiment according to the invention, based on the first embodiment, FIGS. 5*a* to 5*d* a fifth embodiment according to the invention, FIGS. 6*a* to 6*d* a clamping spring in profile view, side view, top view and in perspective, FIGS. 7A to 7B an example of a plug connector configuration of two paired plug connector devices having screwless contact elements, FIGS. 8*a* to 8*d* a sixth embodiment according to the invention, based on the first embodiment, FIGS. 9*a* to 9*d* a seventh embodiment according to the invention, based on the first embodiment, FIGS. 10*a* to 10*d* a eighth embodiment according to the invention, based on the first embodiment, FIGS. 11*a* to 11*d* a ninth embodiment according to the invention, based on the first embodiment, FIGS. 12*a* to 12*d* a tenth embodiment according to the invention, based on the first embodiment, FIGS. 13*a* to 13*d* a eleventh embodiment according to the invention like the fifth embodiment, FIGS. 14*a* to 14*g* a twelfth embodiment according to the invention based on an embodiment similar to the first embodiment, FIGS. 15*a* to 15*b* another embodiment according to the invention, namely with a filled interior and with a component received in the interior, FIG. 16 an embodiment corresponding to FIG. 2*c*, but molded by using a die-casting method, FIG. 17 an embodiment corresponding to FIG. 3*b* but molded by using a die-casting method, FIG. 18 an embodiment corresponding to FIG. 5*c* but molded by using a die-casting method, FIG. 19 an embodiment corresponding to FIG. 8*c* but molded by using a die-casting method, FIG. 20 an embodiment corresponding to FIG. 9*c* but molded by using a die-casting method, FIG. 21 an embodiment corresponding to FIG. 12*c* but molded by using a die-casting method.
Figure 1A:
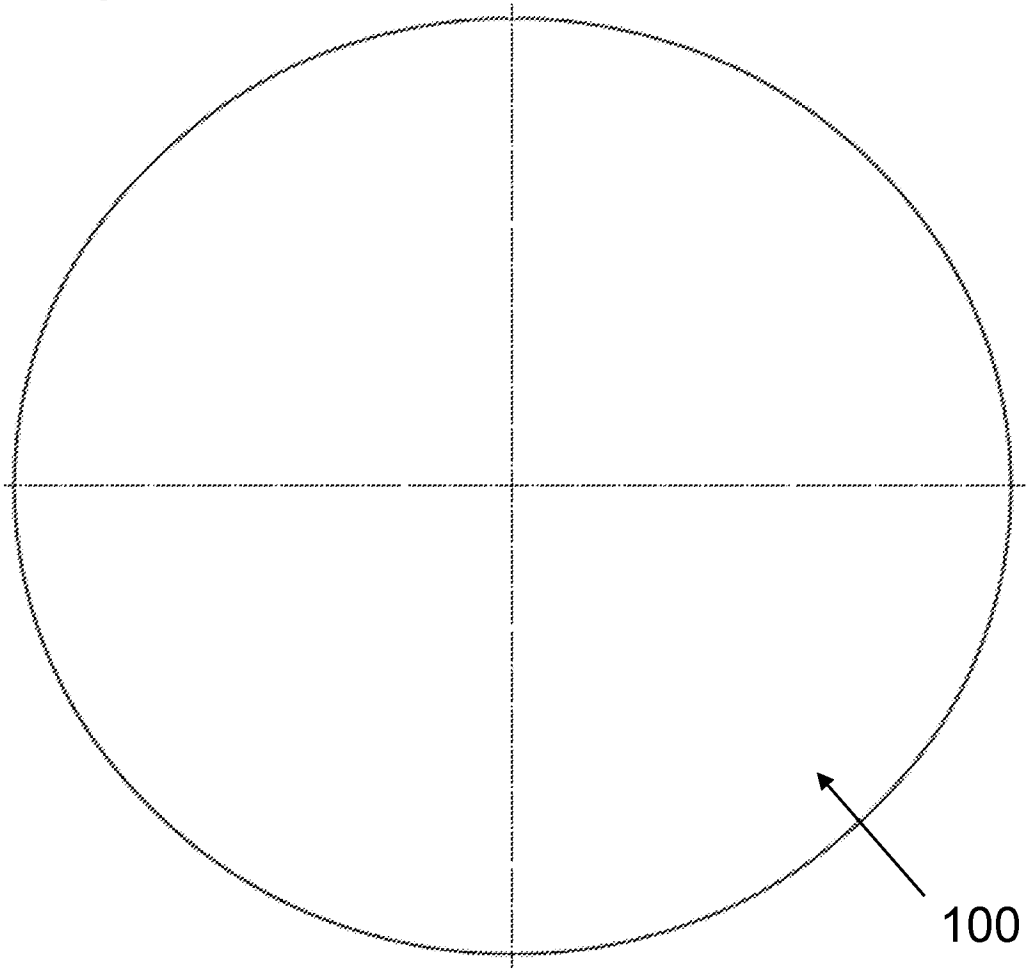
Figure 7A:
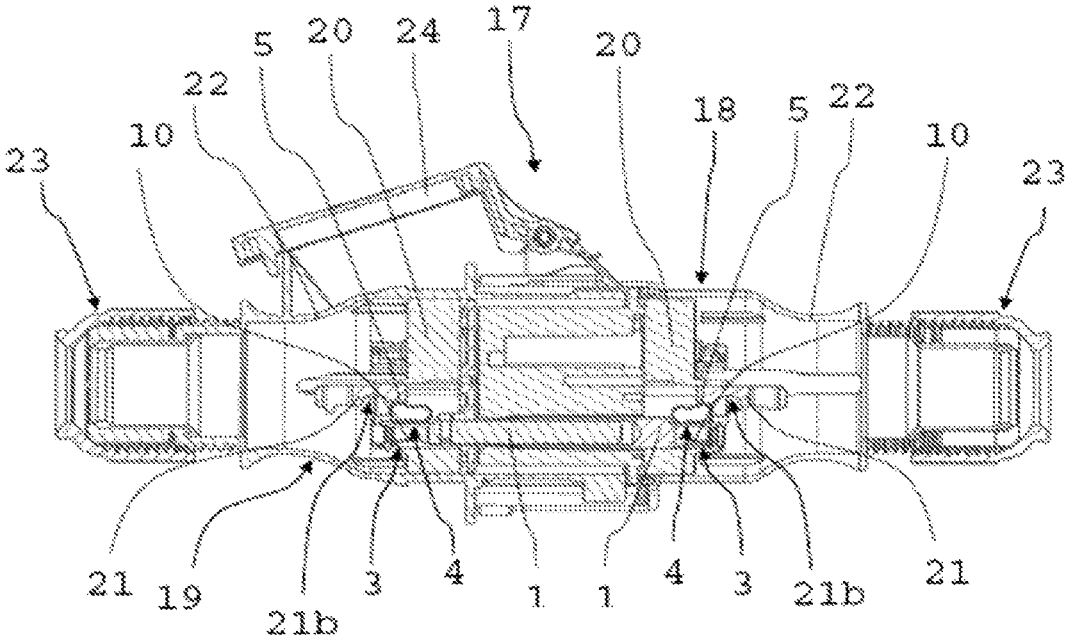
Figure 7B:
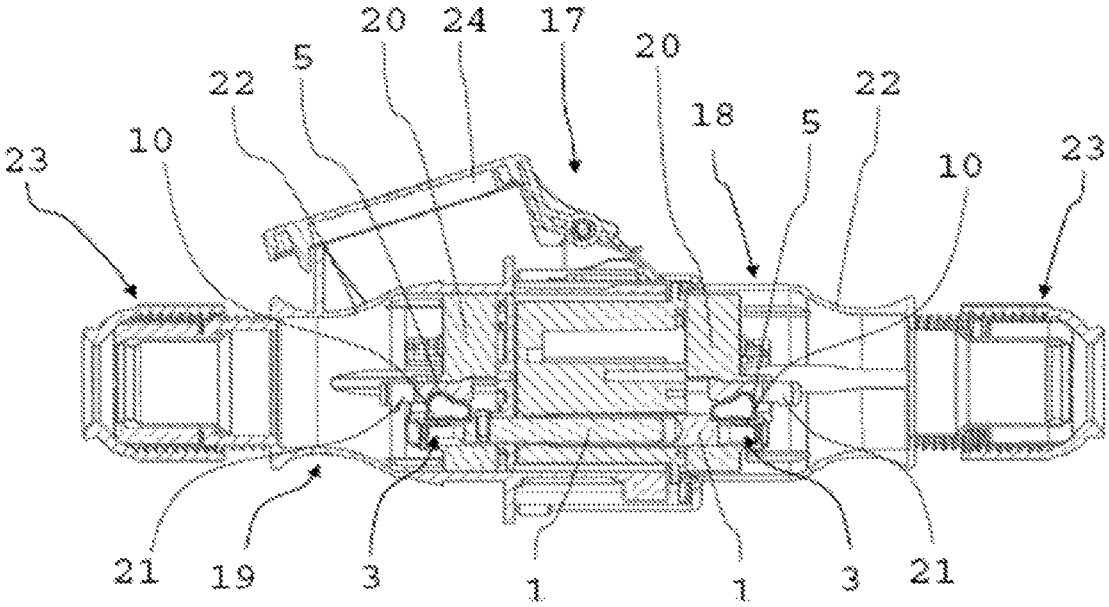

Reference is made below to FIGS. 1*a* through 1*b*, which show a first embodiment of a contact element according to the invention for an electrical plug connector device (as shown in FIGS. 7A, 7B, for example).

The contact element has an elongated receiving section 101 and a first end section 102, wherein the receiving section 101 extends from the first end section 101, essentially in the form of a hollow cylinder for mechanical and electrical coupling and/or for receiving a mating contact element, which is designed to be complementary to the contact element but is not shown here, as part of a plug connector device, which is to be paired with the electrical plug connector device. The elongated hollow cylindrical receiving section 101 here is shown to be free of material transitions and is molded from an electrically conductive material, just as the first end section 102 is molded from this electrical conductive material. The end 103 on the receiving section 100 opposite the first end section 102 is closed.

The hollow cylindrical receiving section 101 is characterized by freedom from seams and freedom from material transitions and consequently is completely closed on the circumference, i.e., on the cylindrical surface.

As FIGS. 1*a* and 1*b* show, the elongated hollow cylindrical receiving section 101, including the regions 102 and 103, is molded from a flat material. A circular flat material 100 has been used in the embodiment shown here, with the elongated hollow cylindrical receiving section 101 including the regions 102 and 103 being molded from it by using a deep-drawing method. In an alternative embodiment of the invention, instead of a deep-drawing method, for example, an impact extrusion method, preferably a hollow reverse impact extrusion method or a hollow forward impact extrusion method may preferably also be used.

For use of the preferred deep-drawing or impact extrusion method mentioned above, the first end section 102 is designed with a type of peripheral collar 104. If the "stamp" for hollow cylindrical internal shaping of the receiving section 101 is inserted from the side of the end section 102, which is then the first end section, then a less complex deep-drawing or impact extrusion mold is sufficient to provide such a first end section 102 or one that is similar.

Such a first end section 102 or one that is similar or one that is similar and has a peripheral collar 104 of such a type or a similar type may already provide a connecting device which is molded from one piece together with the receiving section and/or for receiving an electrical connecting conductor, wherein the connecting conductor is soldered or welded to the collar, for example, in this case.

This first embodiment thus follows a first embodiment of the invention, according to which the receiving section molded by molding the material of the electrically conductive material forms a cylindrical interior along the longitudinal axis, this interior being sheathed by the molded electrically conductive material, however, such that there is no separate filling of the cylindrical interior, and consequently, the receiving section forms a hollow cylindrical receiving section.

Alternatively, the elongated hollow cylindrical receiving section 101 illustrated in FIG. 1*b*, including the regions 102 and 103, may also be molded by using a die-casting method.

In a refinement of the embodiment according to FIGS. 1*a* and 1*b*, modified embodiments are shown in the embodiments according to FIGS. 2*a* through 2*d*, 3*a* to 3*c* and 4*a* to 4*d*, in which alternative connecting devices designed with little effort on a first end section 102 according to Figure lb or a similar first end section are joined to the receiving section.

The elongated hollow cylindrical receiving sections 101, including the first end section 102 and the end 103 that is opposite this end section, as shown in FIGS. 2*a* through 2*d*, 3*a* to 3*c* and 4*a* to 4*d*, are preferably again manufactured from flat materials according to Figure la, from which the elongated hollow cylindrical receiving section 101, including the regions 102 and 103, is expediently molded by using a deep-drawing method or an impact extrusion method.

Figure 2D:
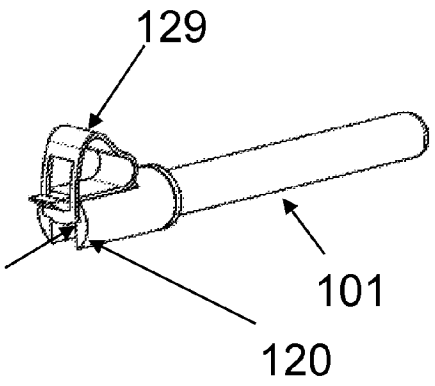
Figure 2C:
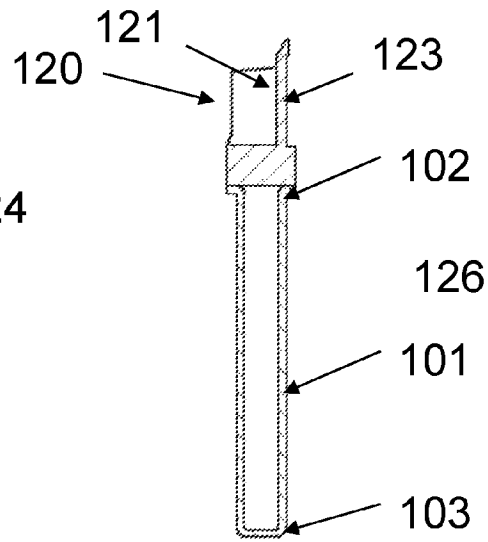

In the embodiment according to FIGS. 2*a* to 2*d*, a connecting device for mechanical and electrical coupling and/or for receiving an electrical connecting conductor having a connecting section 120 is formed on the first end section 102 (FIGS. 2*c*, 2*d*).

As one option, this connecting section 120 may already be supplied as a connecting device. The connecting section 120 shown here was previously molded (FIGS. 2*a* and 2*b*) from an electrically conducting solid material 115 (FIG. 2*a*) by using a material-removing method and then mounted on the receiving section 101 on the first end section 102 by soldering, for example. However, it should be pointed out that the connecting section 120 can fundamentally also be screw-connected, riveted or joined by some other method, for example, by welding, depending on the specific embodiment. Thus, an electrical connecting conductor may be secured by soldering, for example, on the connecting section 120 as a connecting device for mechanical and electrical coupling and/or receiving.

It is provided as a particular additional option according to FIG. 2*d* that the connecting device is designed in multiple parts and the connecting device has, for example, the connecting section 120 and a clamping spring 129, which is secured on the connecting section 120.

To this end, the connecting section 120 has a contact face 121, for example, mounted on it, the connecting line to be connected being placed on it to establish an electrical contact, and furthermore, a guide lug 122, which has a chamfer and widens the contact face 121, is furnished. On the one hand, the chamfer may simplify the mounting of the clamping spring 129 on the connecting section 120, and on the other hand, it fulfills the function of a conductor guide (even when a clamping spring is not inserted), so that a connected terminal conductor can be lead away from the connecting section 120 harmlessly, i.e., without sharp edges or kinking. In addition, the connecting section 120 is preferably provided with a recess 123 with respect to the contact face 121, e.g., in the form of a milled groove to receive a contact leg of the clamping spring 129, when use with a clamping spring. A guide recess 124, which is milled in the connecting section 120, serves to engage with a conductor terminal extension on the clamping spring 129, for example, while lateral supporting legs 125 secure it, so that a contact leg of the clamping spring 129 is applied to the end face 126 of the connecting section 120.

A possible, especially preferred embodiment of a clamping spring 129 is illustrated in FIGS. 6*a* to 6*d*. This clamping spring 129 is a metal clamping spring, which is molded by using a blanking-bending method and has both a clamping leg 7 and a contact leg 8. The two spring legs 7, 8 are connected to one another via a tension leg 9. A clamping opening 6 is recessed in the clamping leg 7 of the clamping spring 129 and permits an intersection of the clamping leg 7 and the contact leg 8 by means of a partial section 8*b* of the contact leg 8. A clamping opening 6 of the clamping spring 129 permits the insertion of conductor wires of a connecting conductor in the insertion direction E. The clamping leg 7 also has a conductor terminal extension 10, which is bent essentially at a 90° angle to the clamping leg 7 of the clamping spring 129, so that the conductor terminal extension is aligned in the direction of the contact leg 8 and its clamping face 11 is oriented essentially in the manner of a clamping plate parallel to its surface. The conductor terminal extension 10 thus extends from the clamping leg 7 in the insertion direction E of a connecting conductor, which is to be connected electrically. The conductor terminal extension 10 may also be equipped with an additional clamping section 10*b*, whose clamping face 11*b* is angled or curved in relation to the clamping face 11 of the conductor terminal extension 10.

In the refinement according to FIG. 2*d*, the connecting device, which is designed in multiple parts on the first end section, is thus molded by using a material-removing method and a blanking-bending method.

Figures 16, 17, 18, 19, 20, 21:
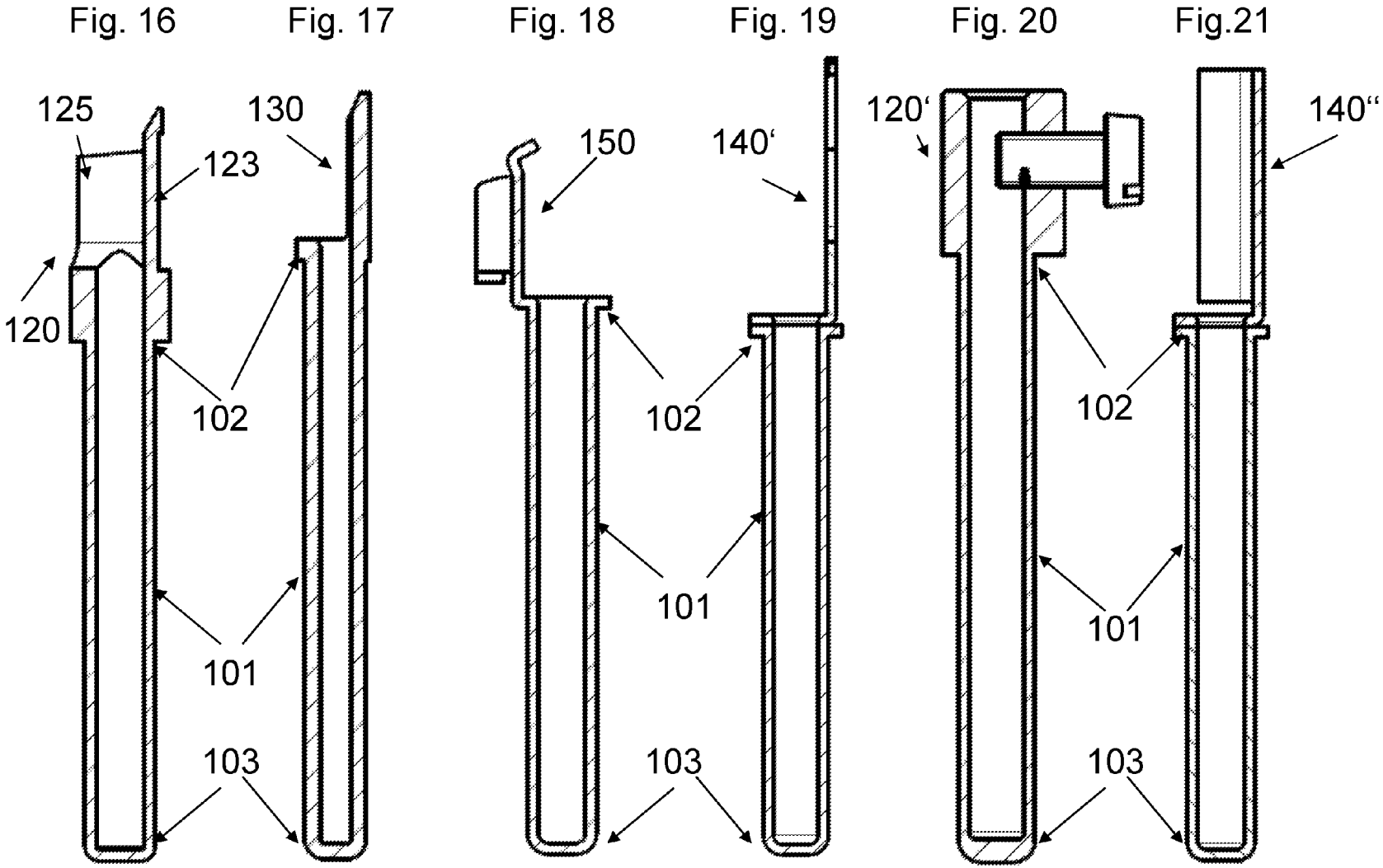

Alternatively, an elongated hollow cylindrical receiving section 101, including the regions 102 and 103 and a connecting section 120, corresponding to FIG. 2*c* may also be molded by using a die-casting method, and when used with a clamping spring, it may be molded by using a die-casting method, preferably with a recess 123, situated opposite a contact face 121. A contact element molded in this way is shown in a sectional view in FIG. 16, for example.

Figure 3C:
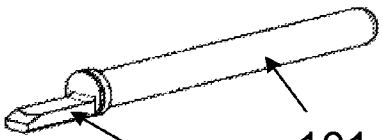
Figure 2B:
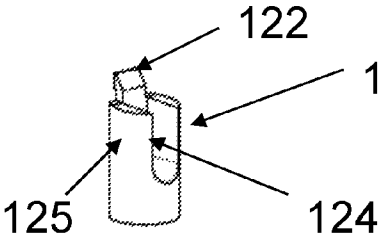
Figure 3B:
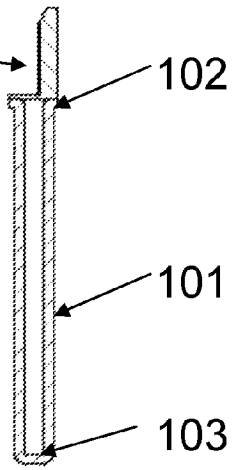
Figure 2A:
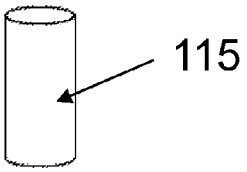
Figure 3A:
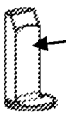

In the embodiment according to FIGS. 3*a* to 3*c*, a connecting device for mechanical and electrical coupling and/or for receiving an electrical connecting conductor is formed on the first end section 102 and has a modified design of the connecting section 130 in comparison with that in FIGS. 2*b* to 2*d*.

The connecting section 130, in modification of that shown in FIGS. 2*b* to 2*d*, in particular does not have a recess opposite a contact face and does not have guide recess or a lateral supporting leg and therefore can be manufactured more easily in the shaping and/or cutting method.

As one option, this connecting section 130 may already be supplied as a connecting device. The connecting section 130 shown here was previously (FIGS. 3*a* and 2*a*) molded from an electrically conducting solid material 115 (FIG. 2*a*) by using a material-removing method and then mounted on the receiving section 101 on the first end section 102. An electrical connecting conductor may thus in turn be secured on the connecting section 130 as the connecting device for mechanical and electrical coupling and/or receiving.

As another option not shown here, however, it is also possible to provide in this embodiment that the connecting device is designed in multiple parts, and the connecting device, for example, also has a clamping spring in addition to the connecting section 130, the clamping spring being attached to the connecting section 130.

Alternatively, an elongated hollow cylindrical receiving section 101, corresponding to that in FIG. 3*b*, including the regions 102 and 103 as well as the connecting section 130 may also be molded by using a die-casting method. A contact element molded in this way can be seen in a sectional view in FIG. 17, for example.

In the embodiment according to FIGS. 4*a* to 4*d*, a connecting device for mechanical and electrical coupling and/or for receiving an electrical connecting conductor is formed on the first end section 102 and has a connecting section 140 with an alternatively modified design in comparison with FIGS. 2*b* to 2*d*.

As one option, this connecting section 140 may in turn be supplied on a connecting device. The connecting section 140 shown here was previously molded (FIGS. 4*a* and 4*b*) from an electrically conducting material, in particular a flat material 116 (FIG. 4*a*) in a modification of that in FIGS. 2*b* to 2*d* by using a blanking-bending method and then was attached to the first end section 102 on the receiving section 101. An electrically connecting conductor may thus be secured on the connecting section 140 as the connecting device for mechanical and electrical coupling and/or receiving.

Figure 4D:
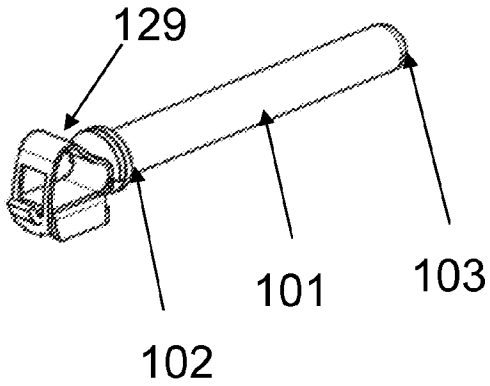

As a special additional option according to FIG. 4*d*, it is provided that the connecting device is in turn designed of multiple parts and the connecting device has the connecting section 140, for example, and a clamping spring 129, which is attached to the connecting section 140.

The connecting section 140 has a contact face 141, on which the connecting conductor that is to be connected is placed to establish an electrical contact, preferably like the connecting section 120 according to FIGS. 2*b* to 2*d*, and furthermore, a guide lug 142, which has a chamfer and enlarges the contact area. On the one hand, the chamfer may simplify the mounting of the clamping spring 129 on the connecting section 140, and on the other hand again, it fulfills the function of a conductor guide (even in the case of the clamping spring that is not used). In addition, the connecting section 140 has a guide, which serves for engagement of a conductor terminal extension on the clamping spring 129, for example, while lateral supporting legs 145 secure it, wherein a clamping leg of the clamping spring 129 may again be placed in contact with the end face of the connecting section 140. The lateral supporting legs 145 may also expediently define a conductor space and thus may also represent a lateral limitation as well as a lateral support for a conductor to be inserted. However, the lateral supporting legs 145 could also be used for direct fixation of an electrical connecting conductor on the connecting section 140 if the connecting section 140 should optionally already supply the one piece connecting device.

In another alternative embodiment according to FIGS. 5*a* to 5*d*, it is also provided that the connecting device formed on the first end section and the receiving section may be molded from one piece.

In the embodiment according to FIGS. 5*a* to 5*d*, a connecting device for mechanical and electrical coupling and/or for receiving an electrical connecting conductor having a connecting section 150 is formed on the first end section 102.

As one option, this connecting section 150 may in turn already be supplied as a connecting device.

Figures 5A, 5B, 5C, 5D:
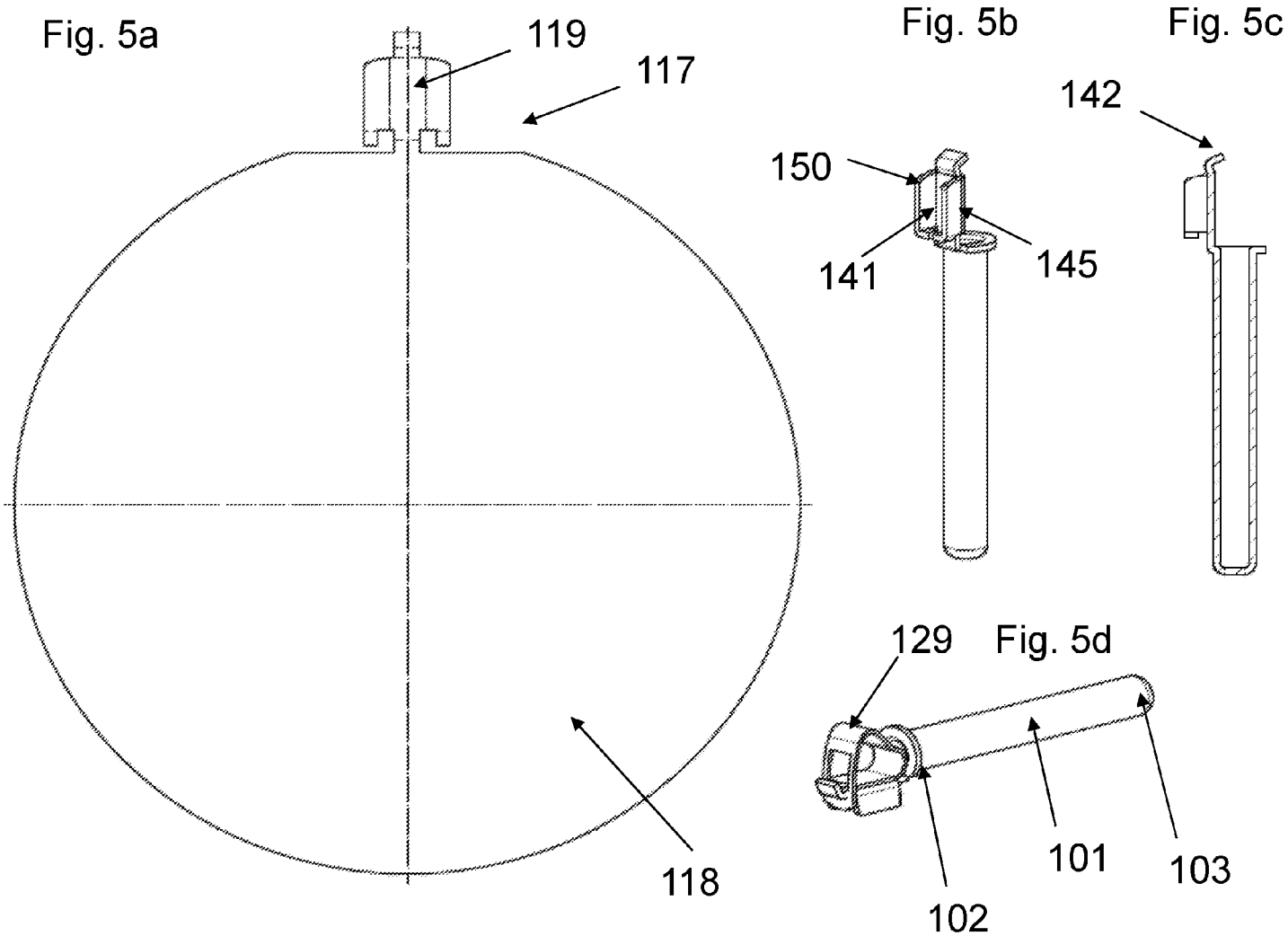
Figure 6A:
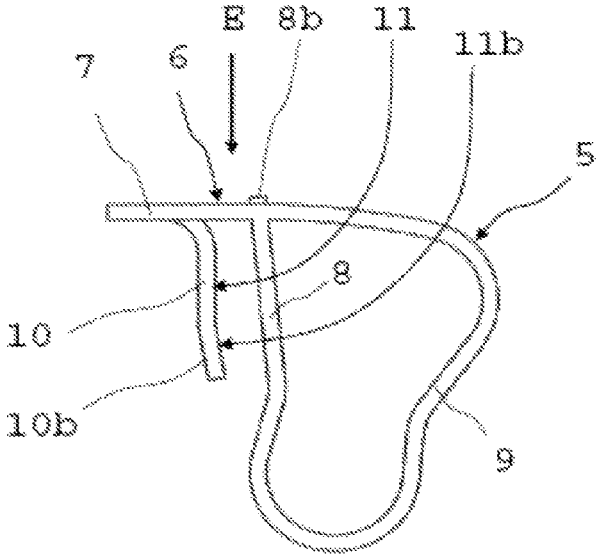
Figure 6B:
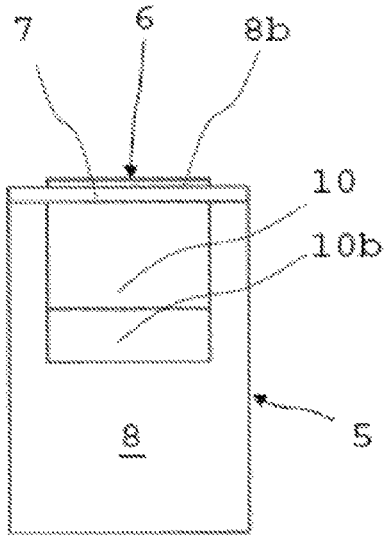
Figure 6C:
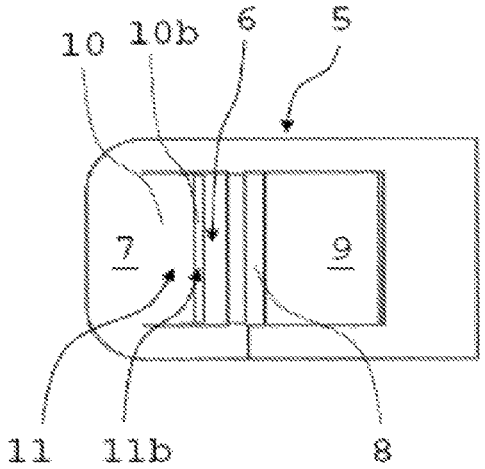
Figure 6D:
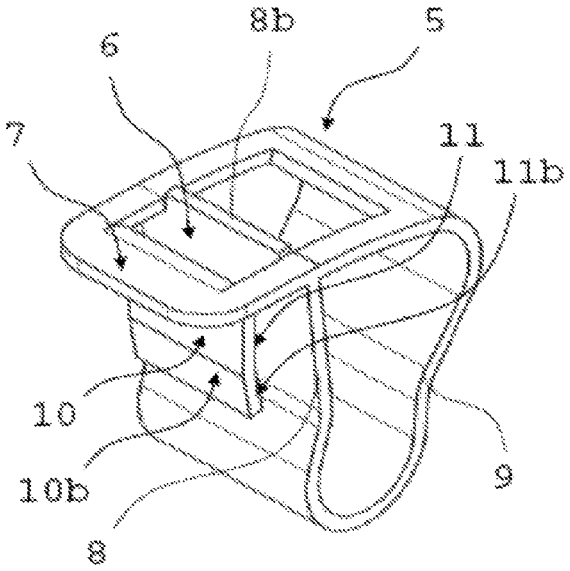

It is provided as a special additional option according to FIG. 5*d* that the connecting device is again designed in multiple parts, and the connecting device has the connecting section 150, for example, and a clamping spring 129, which is attached to the connecting section 150.

Figure 4C:
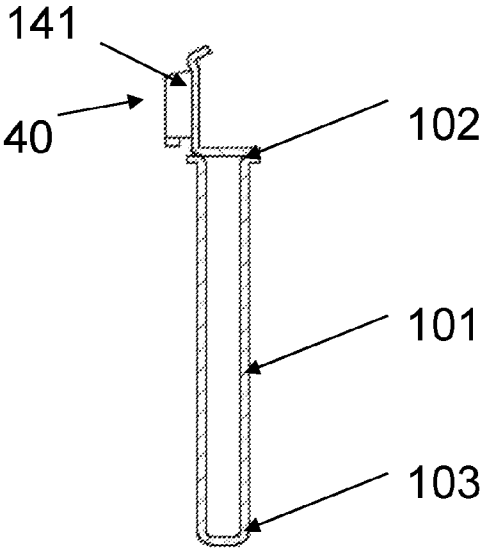
Figure 4B:
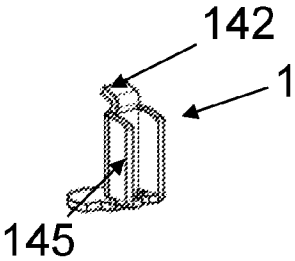
Figure 4A:
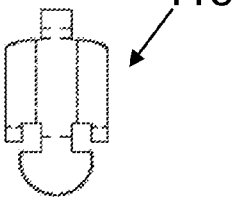

The connecting section 150 preferably has a contact face 141, as in the case of the connecting section 140 according to FIGS. 4*b* to 4*d*, and the connecting conductor to be connected is placed on this contact face to establish an electrical contact, and furthermore, it has a guide lug 142 with a chamfer. The chamfer may in turn simplify the mounting of the clamping spring 129 on the connecting section 150, while on the other hand, it fulfills the function of a conductor guide (even with the clamping spring not inserted). In addition, the connecting section 150 has a guide, which serves to engage a conductor terminal extension on the clamping spring 129, for example, while lateral supporting legs 145 secure it and in turn a clamping leg of the clamping spring 129 may be placed on the end face of the connecting section 150. The lateral supporting legs 145 here may expediently also define a conductor space and may also represent a lateral limitation as well as a lateral support for a conductor to be inserted. However, the lateral supporting legs 145 may in turn be used for direct fixation of an electrical connecting conductor on the connecting section 150, for example, if the connecting section 150 should optionally also supply the connecting device.

However, in a modification of FIGS. 4*b* to 4*d* as well as all other embodiments described previously, the connecting section 150 shown here has previously been molded (FIG. 5*a*) from one piece, in particular from one piece of a flat material 117, together with the elongated hollow cylindrical receiving section 101 including the regions 102 and 103.

In the embodiment shown here, a flat material 117 having a first region 118 for shaping the receiving section 101, including the regions 102 and 103, is used for this purpose. This first region extends into a second region 119 at one side for shaping of the connecting section 150 of the flat material extension 119.

The first region 118 is preferably essentially circular, so that the elongated hollow cylindrical receiving section 101 including the regions 102 and 103 can be molded from this first region by using a deep-drawing method or an impact extrusion method, and then the connecting section 150 can be formed from the extension region 119 by using a blanking-bending method.

An electrical connecting conductor may thus in turn also be secured directly on the connecting section 150 as a connecting device for mechanical and electrical coupling and/or receiving.

Alternatively, an elongated hollow cylindrical receiving section 101, including the regions 102 and 103 as well as a connecting section 150 corresponding to FIG. 5*c* may also be molded by using a die-casting method. A contact element molded in this way can be seen in a sectional view in FIG. 18 as an example.

It is obvious that with all the embodiments described previously, the end 103 on the elongated hollow cylindrical receiving section 101, opposite the first end section 102, may also be open to form a contact socket, for example. The opening here may be separate according to the design of the receiving section 101 or it may be inserted from the side opposite the side which is then the first end section 102, for example, in deep-drawing or impact extrusion of the "punch" for the hollow cylindrical internal shaping of the receiving section 101. In this case, the first end section 102 may also be closed, depending on the specific mold design.

It will be obvious to those skilled in the art that within the scope of the present invention, connecting devices in which other techniques than clamping, soldering and crimping are used, e.g., a screw connection may also be used for connecting an electrical conductor.

In particular when using a die-casting method or a deep-drawing method or an impact extrusion method, it is thus possible to efficiently obtain a completely closed hollow contact element, while at the same time saving on raw materials through a use-optimized manufacturing method because it does not have any solid material contact element and does not have any visible or invisible transitions, butt joints or the like, which occur with traditional manufacturing methods, for example, blanking-bending methods, rolling methods or the like due to the manufacturing technique. The contact element according to the invention can be manufactured to be completely tight by avoiding transitions, etc., so that no contaminants, moisture or the like can penetrate from the outside. Unwanted oxidation and/or corrosion that could lead to increased transfer resistances in power conduction may thus be prevented.

It is apparent from the preceding description that the embodiments may also vary greatly. Combinations are possible to form a hollow contact element according to the invention, for example, an elongated hollow receiving section, including a first end section from which the receiving section extends up to an end opposite the first end section with a connecting device that is mounted, for example, welded or riveted, or contact elements as a complete die-cast part or a complete deep-drawn part, for example, each optionally with a subsequent cutting (or blanking) and bending sequence.

The contact elements according to the invention are thus suitable in particular for electrical plug connector devices, which, however, may also be designed as a socket and may have a contact insert block, in which these contact elements are to be inserted and which are described in the standards DIN VDE 0623, IEC 60309-1, -2 and EN 60309-1, -2 in particular.

In the accompanying FIGS. 7*a* and 7*b*, for example, a plug connector arrangement 17 consisting of two paired plug connector devices, i.e., a plug and a coupling, is shown with screwless contact elements being inserted, namely those manufactured according to the prior art in the example shown here. The plug connector arrangement 17 is prepared here for two-sided connection to a conductor 2, wherein FIG. 7*a* shows plug connector devices with the clamping openings 6 of clamping legs 7 of clamping springs 5 opened and FIG. 7*b* shows the clamping openings 6 closed.

The plug connector arrangement 17 has a coupling device with a tubular coupling housing 18 as one plug connector device and has a plug device having a plug housing 19 as the other plug connector device to be paired with the former, the two of these devices being plugged into one another and electrically joined by means of contact elements 1 of complementary designs, i.e., contact sockets 1 and contact pins 1, which engage with one another. It should be pointed out that in the views according to FIGS. 7A and 7B, only one contact element within a plug-connecting device is shown for reasons of simplicity, but as a rule, additional contact pins or contact sockets will also be included in the plug connector devices.

The two housings 18, 19 each comprise a cylindrical contact element carrier 20, which is formed with individual receiving chambers to receive additional contact elements 1, is made of an insulating material and can be locked or otherwise connected to the coupling housing 18 and/or the plug housing 19. The number of the respective receiving chambers for the pin-type or socket-type contact elements 1 in each cylindrical contact element carrier 20 will depend on the intended purpose and may have, for example, either three receiving chambers (two phase contacts and one protective wire contact) or four receiving chambers (three phase contacts and one protective ground wire contact) or five receiving chambers (three phase contacts, one neutral conductor contact and one protective ground contact). The two housings 18 and 19 have a protective part in the form of a hood 22 for insertion of a conductor 2 and a rotatably operable strain relief device in the form of a tension sleeve 23. A pivotable cover 24, which covers the contact socket 1 and provides protection against spray water when the coupling 18 is disengaged from the plug 19, is mounted on the coupling housing 18.

Figures 9A, 9B, 9C, 9D, 10A, 10B, 10C, 10D:
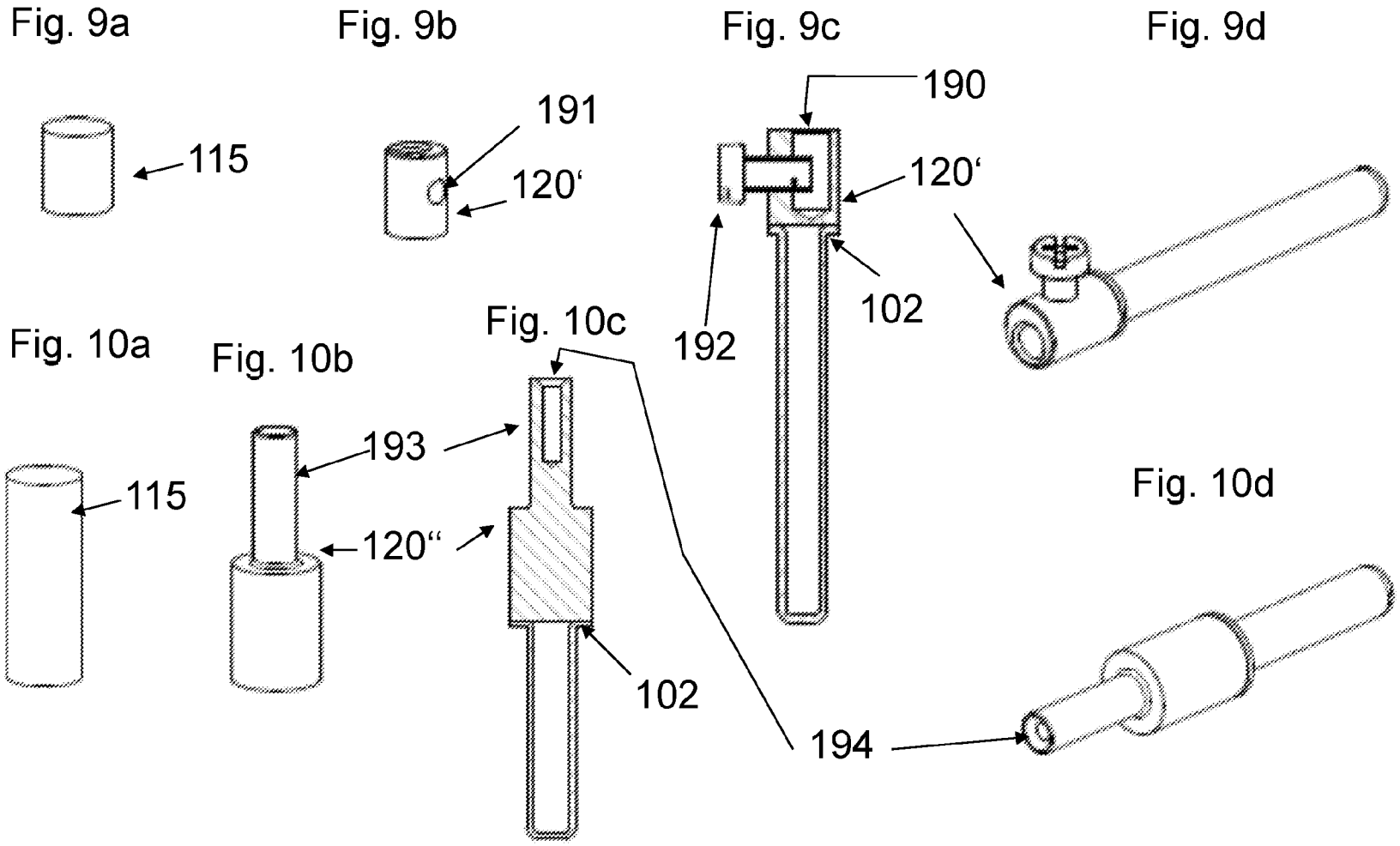

As shown in FIGS. 7A and 7B, the contact faces 4 and the clamping springs 5 of the screwless connecting clamps each extend into individual receiving chambers of the contact element carrier 20. The contact element carrier 20 is provided with access openings through which a locking slide 21 extends as a contact opener. Additional access openings open onto the contact faces 4 of the contact elements 1. The locking slide 21 has a recess 21*b* in which the clamping springs 5 can engage. The locking slide 21 has the function of a hold-down tool, which can assume two positions, namely a release position of the clamping spring, as illustrated in FIG. 9B, and a hold-down position of the clamping spring, as illustrated in FIG. 9A, in which the recess 21*b* holds down the tension leg 9 of the clamping spring 5 and opens the clamping opening 6, so that the free conductor wires 2*b* can be inserted into the clamping opening 6. The two positions of the locking slide 21 mentioned above are determined by stops, which come into contact with the respective shoulders of the contact element carrier 20. To be able to easily locking slide 21 between its two openings, an actuating opening is provided on which a screwdriver, for example, can act and can push the locking slide forward and backward.

Additional connecting sections 140' and 140" having designs modified in comparison with that of connecting section 140 in the embodiment according to FIGS. 4*a* to 4*d* can be seen in the embodiments according to FIGS. 8*a* to 8*d* and according to FIGS. 12*a* to 12*d*.

The connecting sections 140' and 140", which were again molded previously (FIGS. 8*a*, 8*b* and 12*a*, 12*b*) from an electrically conducting material, in particular a flat material 116' (FIG. 8*a*) or 116" (FIG. 12*a*), by using a blanking-bending method and were then mounted on the receiving section 101 on the first end section 102, can already be supplied as the connecting device.

In modification of the embodiment according to FIGS. 4*a* to 4*d*, the connecting section 140' in the embodiment according to FIGS. 8*a* to 8*d* is designed as a cutting clamping device, and the connecting section 140" in the embodiment according to FIGS. 12*a* to 12*d* is designed as a crimping clamping device.

An electrical connecting conductor may thus in turn be secured directly on the connecting section 140' or 140" as the connecting device for mechanical and electrical coupling and/or receiving.

Figure 8D:
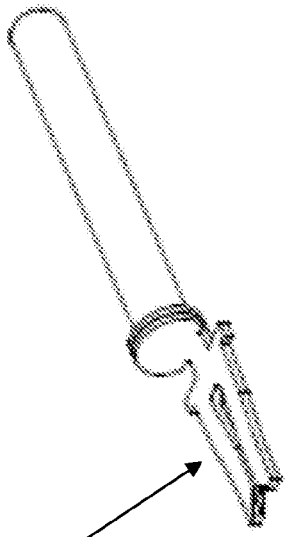
Figure 8C:
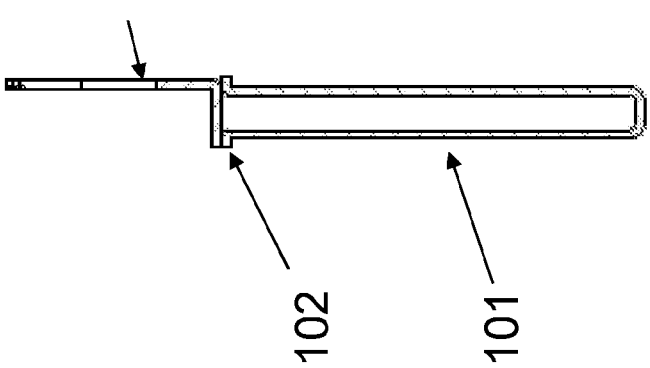
Figure 8B:
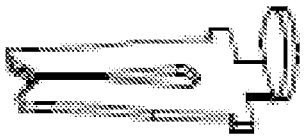
Figure 8A:
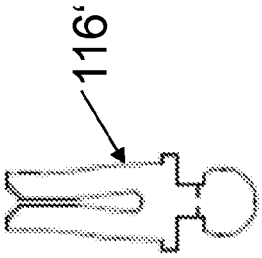
Figures 11A, 11B, 11C, 11D, 12A, 12B, 12C, 12D:
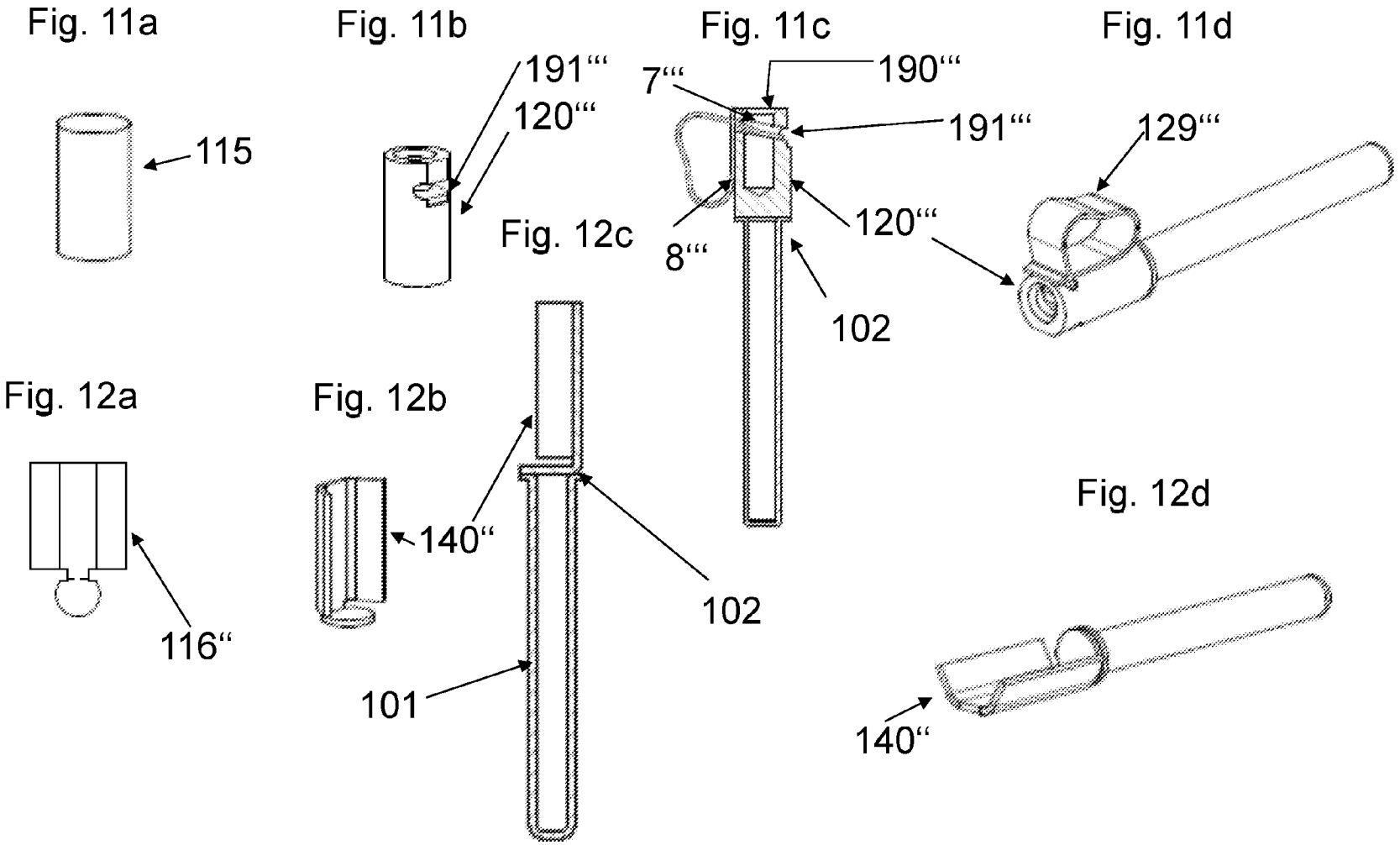
Figure 13A:
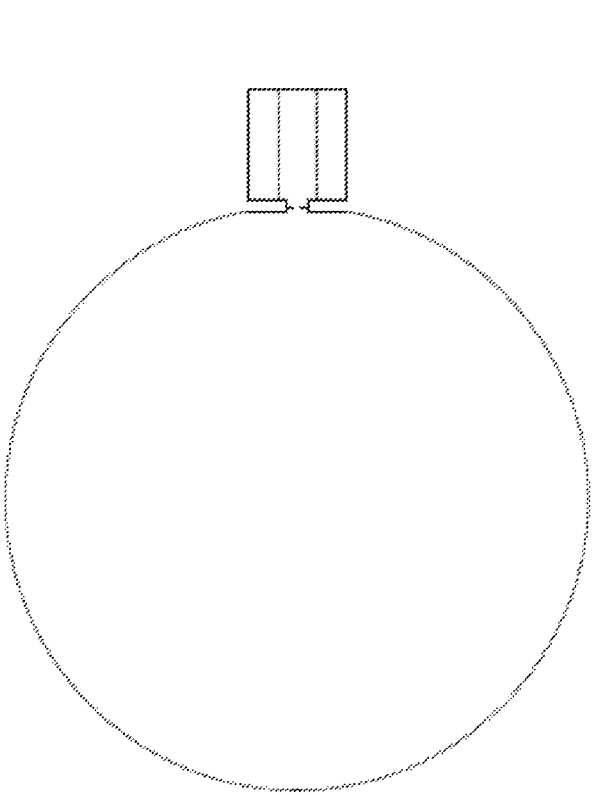
Figure 13B:
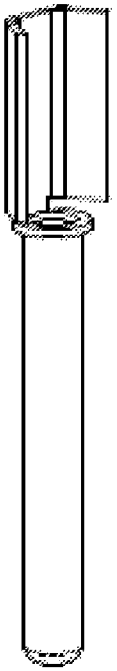
Figure 13C:
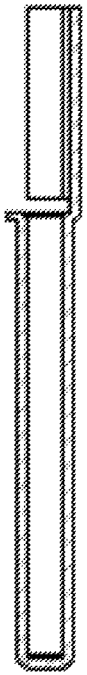
Figure 13D:
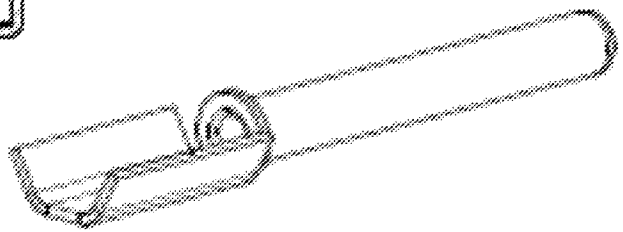

Alternatively, an elongated hollow cylindrical receiving section 101 according to FIG. 8*c* or 12*c*, including the region 102 and 103 as well as a connecting section 140' and/or 140" may also be molded by using a die-casting method. Such a molded contact element is shown in a sectional view in FIG. 19 and FIG. 21 as an example.

Additional connecting sections 120', 120" and 120'" having a modified design in comparison with the connecting section 120 of the embodiment according to FIGS. 2*a* to 2*d* can also be seen in the embodiments according to FIGS. 9*a* to 9*d*, according to FIGS. 10*a* to 10*d* and/or according to FIGS. 11*a* to 11*d*.

In the embodiment according to FIGS. 9*a* to 9*d*, a connecting device for a mechanical and electrical coupling and/or for receiving an electrical connecting conductor is formed on the first end section 102. In this end section, the connecting section 120' formed from the electrically conducting solid material 115 is designed as a cylinder with a borehole running parallel to the longitudinal direction, a modified design in comparison with that in FIGS. 2*b* to 2*d*. In the embodiment of a blind hole 190 shown here for mechanical and electrical coupling and/or for receiving an electrical connecting conductor and a borehole 191 extending crosswise in this borehole 190 is molded with a thread, such that a screw 192 can be screwed into the borehole 191 with a thread for securing an electrical connecting conductor received there within the borehole 190.

Alternatively, an elongated hollow cylindrical receiving section 101, including the regions 102 and 103 as well as a connecting section 120' corresponding to FIG. 9*c* may also be molded by using a die-casting method. A contact element molded in this way can be seen in a sectional view in FIG. 20, for example.

In the embodiment according to FIGS. 10*a* to 10*d*, a connecting device for mechanical and electrical coupling and/or to receive an electrical connecting conductor is formed on the first end section 102. In this embodiment, the connecting section 120" formed from the electrically conducting solid material 115 is molded as a cylinder in modification of that in FIGS. 2*b* to 2*d*, this cylinder being divided into two regions, each having different diameters. The region 193 with a reduced diameter is arranged at the end of the connecting section 120" remote from the receiving section 101 and is equipped with a borehole 194 running parallel to the longitudinal direction for mechanical and electrical coupling and/or to receive an electrical connecting conductor. For fixation of an electrical connecting conductor within the borehole 194, for example, the connecting conductor may be the internal portion of a connecting plug (not shown), for example, a chinch plug (RCA plug), wherein the outer part fixedly surrounds the region 193 with a reduced diameter. Alternatively, a shrink-fit tubing, for example, which has a diameter and a length, such that it can securely reach around both the region 193 with a reduced diameter and a region of the connecting conductor following this region when in the shrunken state may also be used for this fixation.

In the embodiment according to FIGS. 11*a* to 11*d*, a connecting device for mechanical and electrical coupling and/or for receiving an electrical connecting conductor is formed on the first end section 102; in this embodiment, the connecting section 120'" formed from the electrically conducting solid material 115 is molded as a cylinder in modification of FIGS. 2*b* to 2*d*.

As in the embodiment according to FIGS. 9*a* to 9*d*, in the embodiment according to FIGS. 11*a* to 11*d* a borehole running parallel to the longitudinal direction is formed in the connecting section 120'" which is molded as a cylinder; in the embodiment of a blind borehole 190'" shown here this is formed for mechanical and electrical coupling and/or for receiving an electrical connecting conductor. However, a through-hole 191'" extending through the cylinder is formed crosswise through this borehole, a clamping leg 7'" of a clamping spring 129'" being able to pass through this through-hole, while a contact leg 8'" of the clamping spring 129'" is in contact with the jacket of the connecting section 120'" on the outside. The clamping leg 7'" of the clamping spring 129'" has a clamping opening through which the conductor wires of a connecting conductor inserted into the borehole 190'" can be passed when the clamping spring is completely under tension and in which clamping opening the clamping spring is secured together with the clamping spring on the connecting section 120'" after inserting and at least partially relaxing the clamping spring. One possible clamping spring 129'" may thus be designed as illustrated in FIGS. 6*a* to 6*d*, except that no conductor terminal extension is designed according to FIGS. 6*a* to 6*d*.

In the refinement according to FIGS. 11*a* to 11*d*, the connecting device designed on the first end section is again designed in multiple parts and by using a material removing method and a blanking and bending method.

An embodiment according to the invention which is similar to the embodiment according to FIGS. 5*a* to 5*d* is illustrated in FIGS. 13*a* to 13*d*.

However, in a modification of the embodiment according to FIGS. 5*a* to 5*d*, a connecting section in the embodiment according to FIGS. 12*a* to 12*d*, i.e., in particular in the manner of a crimping clamping device is provided in the embodiment according to FIGS. 13*a* to 13*d*, and furthermore, there is no guide lug, as is the case with the embodiment according to FIGS. 5*a* to 5*d*.

Another embodiment based on an embodiment similar to the first embodiment and having a connecting section similar to that of the embodiment according to FIGS. 4*a* to 4*d* is illustrated in FIGS. 14*a* to 14*d*.

The embodiment according to FIGS. 14*a* to 14*d* thus has a connecting section 140''' which is molded like the connecting section 140 according to FIGS. 4*a* to 4*d*, and the connecting section 140''' and the receiving section 101 including the regions 102' and 103 are each molded from separate pieces.

In other words, the receiving section 101 including regions 102' and 103 is molded from one piece, in particular one piece of a flat material 100, like the embodiment according to FIGS. 1*a* and 1*b*, and the connecting section 140''' was previously molded (FIGS. 14*a* and 14*b*) by using a blanking and bending method from another piece of an electrically conducting material, in particular a flat material 116 (FIG. 14*a*) and then mounted on the first end section 102' on the receiving section 101.

For mounting the connecting section 140''' on the end section 102' however, it is provided that a type of pushbutton mechanism is to be supplied.

Figures 14A, 14B, 14C, 14D, 14E, 14F, 14G:
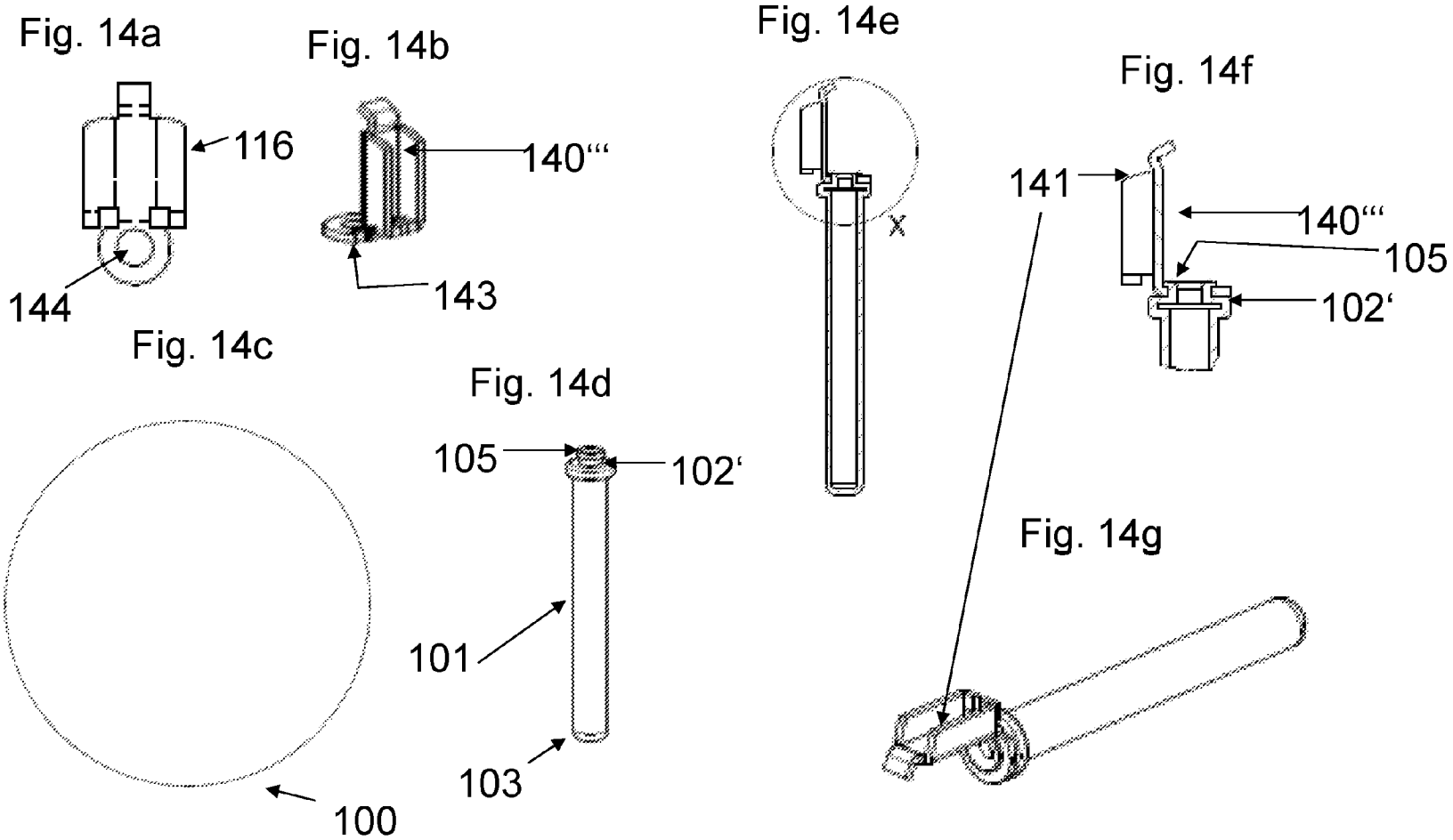

To this end, a region 143 of the connecting section 140''' which is to be connected to the end section 102' and is bent essentially at a right angle to the contact face 141 is provided with an annular passage 144, and the end section 102' is additionally provided with a head 105, which can snap into the annular passage 144, as shown in FIG. 14*f* in particular, by pressing the head 105 and the annular passage 144 into one another.

The head 105 is designed by a corresponding shaping of the material of the end section following the shaping of the receiving section 101, for example.

Figure 15B:
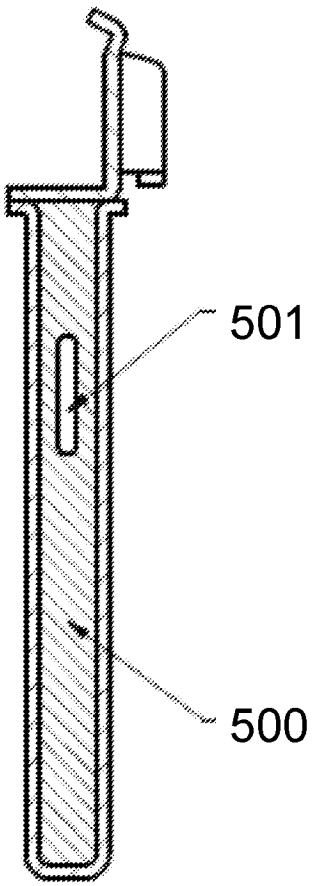
Figure 15A:
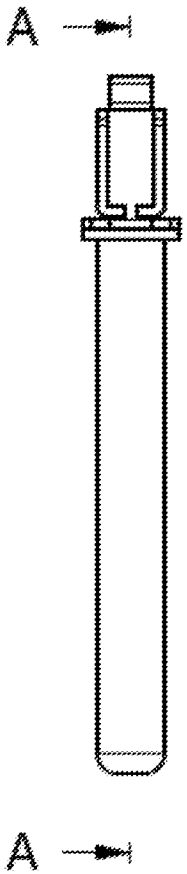

FIGS. 15*a* and 15*b* show another embodiment according to the invention, wherein FIG. 15*b* is a longitudinal section along line AA of FIG. 15*a*. The connecting section corresponds in type and production to the embodiment according to FIGS. 4*a* to 4*d*, but any other method of producing connecting sections according to FIGS. 1 to 14 and FIGS. 16 to 21 may also be used.

However, in modification of all the embodiments described above, the embodiment according to FIGS. 15*a* to 15*b* conforms to a second embodiment of the invention, according to which, by shaping the molded electrically conducting material, the cylindrical interior of the molded receiving section, which is itself sheathed by the molded electrically conducting material, is at least partially filled by another filling material 500 that can be added subsequently, in particular depending on the field of application and/or use and/or it receives a component 501, optionally also several additional components.

Again in this alternative embodiment, in which the cylindrical interior is filled at least partially by another filling material added subsequently and/or the interior receives one or more additional components, the weight and/or the cost of materials can be reduced in comparison with solid material contact elements; the cost of materials can also be reduced in comparison with hollow cylindrical contact pins manufactured first from solid material by cutting or abrasive removal of material. In other words, if an at least partially filled interior is desired or stipulated, depending on the field of use and/or application, at least partial filling may be accomplished by a less expensive material and/or material of a lower density which is thus lighter in comparison with the material used to shape the receiving section. In addition, materials having certain characteristics, in particular having certain physical, chemical and/or electrical characteristics, may also provide such a filling material in a targeted manner.

In particular components for identification, labeling and/or localization have proven suitable for receiving components in the interior. Such components may be of a passive type in particular, i.e., those of a read-only nature, in particular those that can be read out wirelessly or that may be of an active type, i.e., those which can transmit information wirelessly to an external information processing unit, either transmitting it automatically or in response to an inquiry signal. An RFID (radio frequency identification) chip in particular has proven expedient as such a component to be received in the interior. Furthermore, components to be received in the interior may be embedded within a filling material that is to fill the interior at least partially.

What is claimed is:

1. A contact element for an electrical plug connector device, wherein the contact element comprises:

from an electrically conductive material, (i) a molded first end section, and (ii) a molded elongated receiving section, which defines a longitudinal axis, for mechanical and electrical coupling and/or receiving a mating contact element designed to be complementary to the contact element as part of a plug connector device to be paired with the electrical plug connector device, wherein the elongated receiving section extends essentially cylindrically from the first end section, and wherein the first end section and the elongated cylindrical receiving section are molded by shaping the electrically conducting material by means of a force acting at least predominantly parallel to the longitudinal axis, so that both the first end section and the elongated cylindrical receiving section are free of seams and butt joints, and at least the receiving section, which is molded by shaping the electrically conducting material, forms a cylindrical interior sheathed by the molded electrically conducting material along the longitudinal axis and a closed end opposite the first end section on the elongated cylindrical receiving section, wherein a connecting device for mechanical and electrical coupling and/or to receive an electrical connecting conductor is joined onto the first end section, so that the contact element supplies a completely closed contact pin.

2. The contact element according to claim 1, wherein the receiving section is a hollow cylindrical receiving section.

3. The contact element according to claim 1, wherein the cylindrical interior of the receiving section is filled at least partially by another filling material that can be introduced subsequently and/or receives one or more additional components.

4. The contact element according to claim 1, wherein at least the elongated cylindrical receiving section is molded by using a die-casting method or a deep-drawing method or an impact extrusion method.

5. The contact element according to claim 1, wherein the connecting device is designed in multiple parts.

6. The contact element according to claim 1, wherein the connecting device has a clamping spring.

7. The contact element according to claim 1, wherein the connecting device formed on the first end section is molded by using at least one of i) a material removing method and ii) a stamping-bending method.

8. The contact element according to claim 1, wherein at least the elongated cylindrical receiving section is molded by using a deep-drawing method or an impact extrusion method, from a flat material.

* * * * *